US008894841B2

(12) United States Patent
Koseoglu

(10) Patent No.: US 8,894,841 B2
(45) Date of Patent: Nov. 25, 2014

(54) SOLVENT-ASSISTED DELAYED COKING PROCESS

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 66 days.

(21) Appl. No.: 13/493,635

(22) Filed: Jun. 11, 2012

(65) Prior Publication Data

US 2013/0026069 A1 Jan. 31, 2013

Related U.S. Application Data

(60) Provisional application No. 61/513,369, filed on Jul. 29, 2011.

(51) Int. Cl.

| | |
|---|---|
| ***C10G 1/04*** | (2006.01) |
| ***C10B 57/04*** | (2006.01) |
| ***C10B 55/00*** | (2006.01) |
| ***C10G 9/00*** | (2006.01) |

(52) U.S. Cl.

CPC ..... *C10B 57/045* (2013.01); *C10B 55/00* (2013.01); *C10G 9/005* (2013.01)

USPC ..... 208/87

(58) Field of Classification Search

CPC ..... C10G 9/005; C10G 21/003; C10B 1/00; C10B 57/00

USPC ..... 208/390–391, 87

See application file for complete search history.

(56) References Cited

U.S. PATENT DOCUMENTS

| | | | |
|---|---|---|---|
| 2,380,713 | A | 7/1945 | Wilson |
| 3,116,231 | A | 12/1963 | Adee |
| 3,379,638 | A | 4/1968 | Bloomer et al. |
| 3,472,761 | A | 10/1969 | Cameron |
| 3,563,884 | A | 2/1971 | Bloomer et al. |
| 4,036,736 | A | 7/1977 | Ozaki et al. |
| 4,066,532 | A | 1/1978 | Garcia |
| 4,116,815 | A | 9/1978 | Sunago et al. |
| 4,177,133 | A | 12/1979 | Hayashi et al. |

(Continued)

FOREIGN PATENT DOCUMENTS

| | | | |
|---|---|---|---|
| CN | 1176287 | A | 3/1998 |
| EP | 0209225 | A2 | 1/1987 |

(Continued)

OTHER PUBLICATIONS

International Search Report and Written Opinion mailed Aug. 29, 2012 by the European Patent Office in International Application No. PCT/US2012/041897 (13 pages).

*Primary Examiner* — Randy Boyer

*Assistant Examiner* — Juan Valencia

(74) *Attorney, Agent, or Firm* — Abelman, Frayne & Schwab

(57) ABSTRACT

An improved process for the delayed coking of a heavy residual hydrocarbon feedstock to reduce the coking induction period and to enhance the coking process relative to the processes of the prior art is achieved by mixing a sufficient volume of a paraffinic solvent having the formula $C_nH_{2n+2}$, where n=3 to 8 with the heavy feedstock to disturb the equilibrium of asphaltenes in the solution of maltenes in order to flocculate substantially all of the solid asphaltenes particles to thereby increase the yield and quality of valuable liquid products and minimize undesirable cracking reactions that result in high molecular weight polymers and the formation of coke.

20 Claims, 4 Drawing Sheets

(56) References Cited

U.S. PATENT DOCUMENTS

| | | | | |
|---|---|---|---|---|
| 4,216,074 | A | | 8/1980 | Simone |
| 4,455,219 | A | | 6/1984 | Janssen et al. |
| 4,518,487 | A | | 5/1985 | Graf et al. |
| 4,528,088 | A | * | 7/1985 | Chang et al. ..... 208/96 |
| 4,534,854 | A | * | 8/1985 | Weinberg et al. ..... 208/131 |
| 4,686,027 | A | | 8/1987 | Bonilla et al. |
| 4,983,272 | A | | 1/1991 | Stavropoulos |
| 5,028,311 | A | | 7/1991 | Shigley et al. |
| 5,143,597 | A | | 9/1992 | Sparks et al. |
| 5,248,410 | A | | 9/1993 | Clausen et al. |
| 5,370,787 | A | | 12/1994 | Forbus, Jr. |
| RE36,922 | E | | 10/2000 | Sparks et al. |
| 6,673,234 | B2 | | 1/2004 | Li et al. |
| 2009/0266742 | A1 | | 10/2009 | Newman et al. |

FOREIGN PATENT DOCUMENTS

| | | | |
|---|---|---|---|
| EP | 0250136 | * | 12/1987 |
| EP | 0250136 A2 | | 12/1987 |
| EP | 0819157 | * | 1/1998 |
| WO | 2011/005918 A2 | | 1/2011 |

* cited by examiner

SOLVENT-ASSISTED DELAYED COKING PROCESS

RELATED APPLICATIONS

This application claims the benefit of U.S. Provisional Patent Application No. 61/513,369 filed Jul. 29, 2011, the disclosure of which is hereby incorporated by reference.

BACKGROUND OF THE INVENTION

1. Field of the Invention

The present invention relates to an improved process for the delayed coking of heavy residual hydrocarbons that reduces the coking induction period and thereby enhances the coking process.

2. Description of Related Art

A coking unit is an oil refinery processing unit that converts the low value residual oil, or residua, from the vacuum distillation column or the atmospheric distillation column into low molecular weight hydrocarbon gases, naphtha, light and heavy gas oils, and petroleum coke. The process thermally cracks the long chain hydrocarbon molecules in the residual oil feed into shorter chain molecules. Coking is the preferred option for processing vacuum residues containing high level of metals because metals end up in the coke by-product and are disposed of more easily and economically in this solid form. The liquid coker products are almost free of metals. The processing of heavy crude oils having high metals and sulfur content is increasing in many refineries, and as a result the coking operations are of increasing importance to refiners. The increasing concern for minimizing air pollution is another incentive for treating vacuum residues in a coker, since the coker produces gases and liquids having sulfur in a form that can be relatively easily removed from the product stream.

The most commonly used coking unit is a delayed unit, or a "delayed coker". In a basic delayed coking process, fresh feedstock is introduced into the lower part of a fractionator. The fractionator bottoms including heavy recycle material and fresh feedstock are passed to a furnace and heated to a coking temperature. The hot feed then goes to a coke drum maintained at coking conditions where the feed is cracked to form light products while heavy free radical molecules form heavier polynuclear aromatic compounds, which are referred to as "coke." With a short residence time in the furnace, coking of the feed is thereby "delayed" until it is discharged into a coking drum. The volatile components are recovered as coker vapor and returned to the fractionator, and coke is deposited on the interior of the drum. When the coke drum is full of coke, the feed is switched to another drum and the full drum is cooled and emptied by conventional methods, such as by hydraulic means or by mechanical means.

Typical coking unit feedstocks are vacuum residues derived from fossil fuels. Selected properties and characteristics of vacuum residue samples derived from crude oils from the various geographical regions indicated are shown in Table 1. As can be seen from Table 1, vacuum residues have low American Petroleum Institute (API) gravities in the range of from 1 to 20 degrees and a sulfur content that ranges from 0.2 to 7.7 W %. In addition, vacuum residues are rich in nitrogen and can contain metals such as nickel and vanadium in relatively high concentrations which make them difficult to process in other refinery unit operations.

TABLE 1

| | Taching | Brent | Kirkuk | Safaniya | Athabasca | Boscan | Rospomare |
|---|---|---|---|---|---|---|---|
| Specific Gravity | 0.932 | 0.984 | 1.021 | 1.04 | 1.038 | 1.035 | 1.065 |
| API Gravity | 20.3 | 12.3 | 7.1 | 4.6 | 4.8 | 5.2 | 1.4 |
| Viscosity @ 100° F. | 175 | 380 | 870 | 4000 | 1300 | 4000 | 3500 |
| Sulfur | 0.2 | 1.6 | 5.2 | 5.4 | 4.9 | 5.6 | 7.67 |
| Nitrogen | 3800 | 4700 | 4000 | 4300 | 5700 | 7800 | 4200 |
| Conradson Carbon Residue (CCR) | 9.4 | 16.5 | 18 | 24.6 | 16.7 | 19.3 | 26.3 |
| $C_5$-Insolubles | 0.8 | 3.5 | 15.7 | 23.6 | 17.9 | 23.2 | 35.2 |
| $C_7$-Insolubles | 0.3 | 1 | 7.7 | 13.6 | 10.2 | 14.1 | 23.9 |
| Nickel (Ni) ppmv | 10 | 11 | 52 | 44 | 101 | 121 | 71 |
| Vanadium (V) ppmv | 7 | 38 | 125 | 162 | 280 | 1330 | 278 |
| Ni + V ppmv | 17 | 49 | 177 | 206 | 381 | 1451 | 349 |

Vacuum residues also contain asphaltenes in the range 0.3 to 35 W %, depending upon the source of the crude oil. Asphaltenes are defined as the particles precipitated by addition of a low-boiling paraffin solvent such as normal-pentane. It is commonly accepted that asphaltenes exist in solution in the petroleum. Asphaltenes are commonly modeled as a colloid, with asphaltenes as the dispersed phase and maltenes as the continuous phase. Petroleum residua can be modeled as ordered systems of polar asphaltenes dispersed in a lower polarity solvent phase, and held together by resins of intermediate polarity.

As schematically illustrated in FIG. 1, it is known to the prior art that asphaltenes are dispersed by resin molecules, or maltenes, while small molecules such as aromatics act as a solvent for the asphaltenes-resin dispersion and hydrocarbon saturates act as a non-solvent. If crude oil is separated into fractions and then mixed together with less resin content, asphaltenes will only be present as flocculates in solution. Addition of the maltenes or resins brings the asphaltenes back into solution until the equilibrium is disturbed by addition of hydrocarbon saturates, in which case asphaltenes will again start to flocculate.

It is well known and accepted that coke formation is delayed when the asphaltenes are in solution in the petroleum. This delay in coke formation is also referred as the "induction period" which immediately precedes the formation of coke. During this period, valuable lighter components and/or secondary products formed by coking of feedstocks are subject to continued thermal cracking and recombine to form undesirable high molecular weight polymeric compounds.

It is also known from independent studies of the thermal cracking of bitumens that the yield of gaseous products increases with the residence time in the coking unit and that liquid yields are correspondingly reduced.

It is also desirable to produce a coke having a volatile matter content of not more than about 15 W %, and preferably in the range of 6 to 12 W %.

It is therefore an object of this invention to address the problem of how to reduce the coking induction period so that the residence time of the feed in the coke drum is shortened. This will maximize the desired yield of liquids and minimize the coke yield.

As used herein, the terms "coking unit" and "coker" refer to the same apparatus, and are used interchangeably.

SUMMARY OF THE INVENTION

The present invention comprehends an improved process for the delayed coking of heavy residual hydrocarbons that reduces the coking induction period and enhances the coking process by injecting a paraffinic solvent having the formula $C_1H_{2n+2}$, where n=3 to 8 into the feedstock. The improved delayed coking process includes the steps of:

a. introducing a fresh heavy hydrocarbon feedstock containing asphaltenes for preheating into the lower portion of a coking product fractionator;

b. discharging a bottoms fraction that includes the preheated fresh hydrocarbon feedstock from the fractionator as a coking unit combined feedstream;

c. introducing a paraffinic solvent having the formula $C_nH_{2n+2}$, where n=3 to 8, into a mixing zone with the coking unit combined feedstream in a ratio of solvent-to-feedstream of from 0.1:1 to 10:1 by volume to solvent-flocculate all or substantially all of the asphaltenes present in the coking unit combined feedstream;

d. introducing the coking unit combined feedstream containing the flocculated asphaltenes into a coking unit furnace for heating to a predetermined coking temperature; and e. passing the heated combined feedstream containing the solvent-flocculated asphaltenes and paraffinic solvent to a delayed coking drum to produce a delayed coking product stream having an increased portion of liquids and depositing a reduced amount of coke on the interior of the drum, as compared to the amount of coke deposited in the absence of the addition of the paraffinic solvent to the same heavy hydrocarbon feedstock.

In accordance with another embodiment of the invention, the improved delayed coking process comprehends the steps of:

a. introducing a fresh heavy hydrocarbon feedstock containing asphaltenes for preheating into the lower portion of a coking product fractionator;

b. discharging a bottoms fraction that includes the preheated fresh hydrocarbon feedstock from the fractionator as a coking unit combined feedstream;

c. introducing the coking unit combined feedstream into a coking unit furnace for heating to a predetermined coking temperature;

d. mixing downstream of the coking furnace a paraffinic solvent having the formula $C_nH_{2n+2}$, where n=3 to 8, with the furnace heated coking unit combined feedstream in a ratio of solvent-to-feedstream of from 0.1:1 to 10:1 by volume to form solvent-flocculated asphaltenes in the heated coking unit combined feedstream;

e. passing the heated coking unit combined feedstream containing the solvent-flocculated asphaltenes and paraffinic solvent to a delayed coking drum to produce a delayed coking product stream having an increased proportion of liquids and depositing a reduced amount of coke on the interior of the drum, as compared to the amount of coke deposited in the absence of the addition of the paraffinic solvent to the same heavy hydrocarbon feedstock.

The mixing in step (d) referred to in the embodiment described immediately above occurs in a mixing zone upstream of the coking unit or inside the coking drum. In the latter case, paraffinic solvent is injected directly into the coking drum to mix with the incoming feedstream. Where a separate mixing zone is established upstream of the furnace, a rotating disk contactor apparatus can advantageously be employed. Feedstock and solvent can be introduced into the top of the unit and the flocculated portion can be sent to the coking unit from the bottom. This arrangement will prevent or minimize fouling of the mixing apparatus.

The processes and systems of the invention described provide the following benefits:

1. The paraffinic solvent added to the feedstream disturbs the equilibrium of the asphaltenes in the maltenes solution to flocculate the solid particles of asphaltenes. The coking induction period is therefore reduced.
2. The injected paraffinic solvent facilitates the removal of reacted and/or unreacted lighter liquid compounds from the coking drum, and prevents undesirable secondary cracking reactions that form additional free radicals.
3. The residence time for coking reactions is reduced. This minimizes the coking of resin molecules boiling in the vacuum gas oil range to thereby increase the yield of more valuable liquid products.

As residence time increases, the liquids in the feed are subjected to further cracking to produce gaseous products. Since the coke induction period is eliminated by the addition of solvent in accordance with the present invention, the residence time in the coke drum will be shortened and the liquids produced will not be subjected to further cracking. Accordingly, the present improved process yields more liquid and less gaseous products than the same coking process conducted without the addition of a solvent.

The process has been described above and will be described further below with reference to the use of a paraffinic solvent. However, it should be understood that an embodiment of the invention employs as the solvent a portion of the light naphtha stream recovered from the coking product stream fractionator. That product stream includes olefins that are principally $C_5$ to $C_8$ compounds. For convenience and in the interest of brevity, the term paraffinic solvent is used in describing and claiming the invention with the understanding that its source can be the light naphtha that is produced in the process which also includes olefin compounds.

Other aspects, embodiments, and advantages of the process of the present invention are discussed in detail below. Moreover, it is to be understood that both the foregoing summary and the following detailed description are merely illustrative examples of various aspects and embodiments, and are intended to provide an overview or framework for understanding the nature and character of the claimed features and embodiments. The accompanying drawings are included to provide illustration and a further understanding of the various aspects and embodiments. The drawings, together with the remainder of the specification, serve to explain principles and operations of the described and claimed aspects and embodiments.

BRIEF DESCRIPTION OF THE DRAWINGS

The foregoing summary, as well as the following detailed description will be best understood when read in conjunction with the attached drawings in which the same or similar elements are referred to by the same numeral, and where.

DETAILED DESCRIPTION OF THE INVENTION

Figure 1:
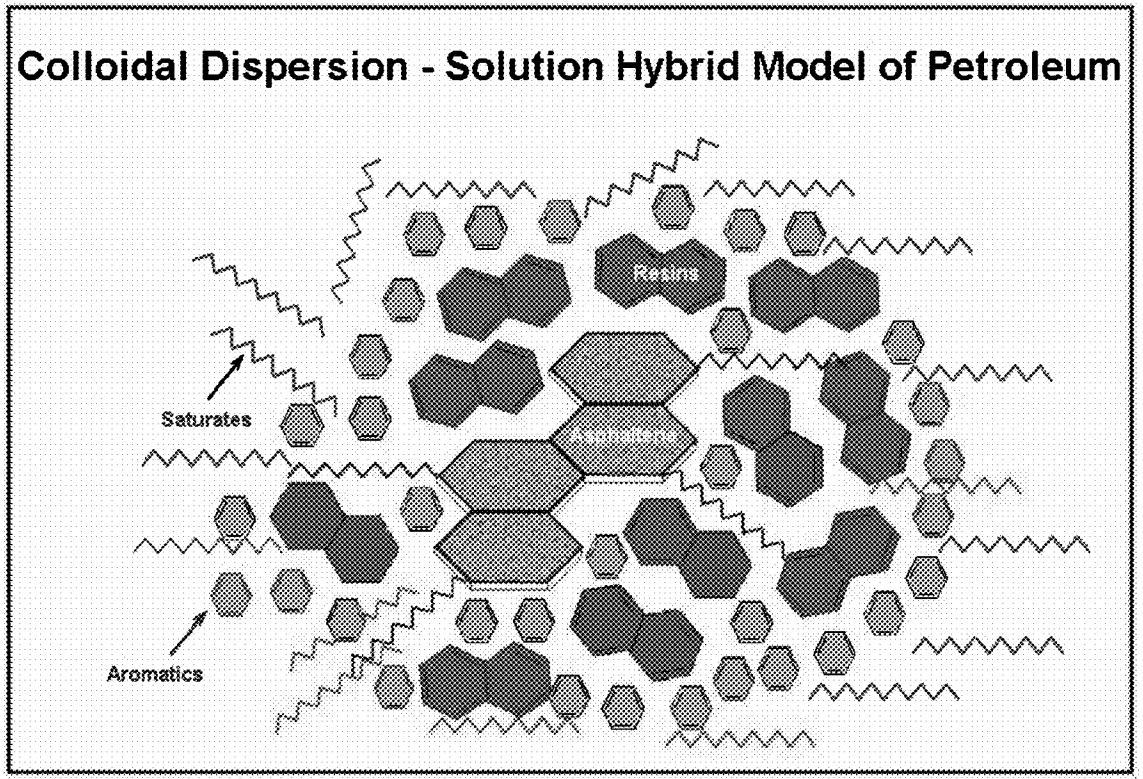
FIG. 1 is schematic a model illustrating generally the nature of the colloidal dispersion of a petroleum mixture.
Figure 2:
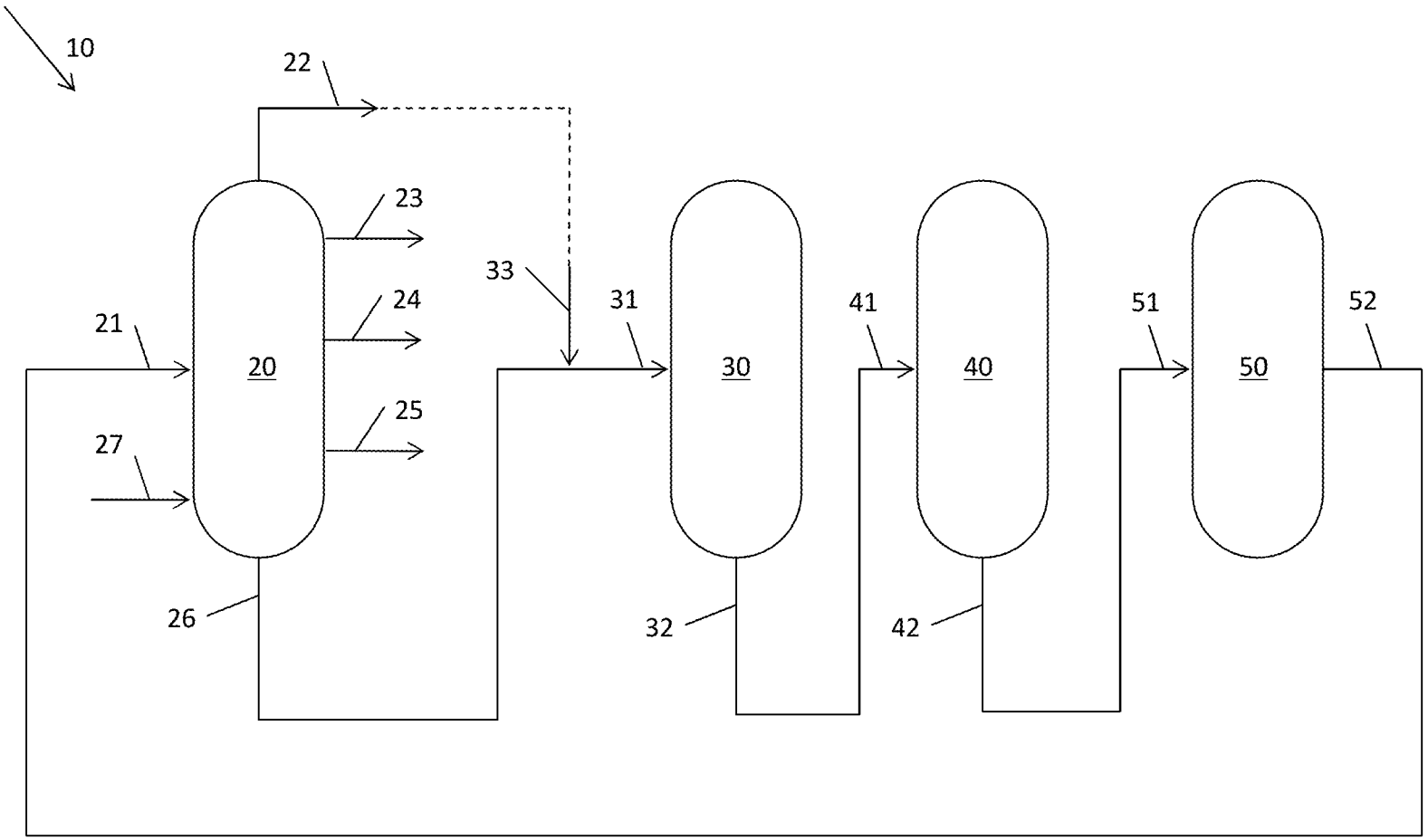
FIG. 2 is a process flow diagram of an improved delayed coking system and process of the present invention.

Referring now to FIG. 2, an improved delayed coking process and apparatus 10 is schematically illustrated. Apparatus 10 includes a fractionator 20, a mixing zone 30, a furnace 40 and a coking drum 50. Fractionator 20 includes an inlet 27 for receiving fresh heavy hydrocarbon feedstock, an inlet 21 in fluid communication with a coking drum outlet 52 for receiving delayed coking product stream. Fractionator 20 also includes an outlet 22 for discharging a light naphtha fraction, an outlet 23 for discharging a heavy naphtha fraction, an outlet 24 for discharging a gas oil fraction, an outlet 25 for discharging a heavy gas oil fraction, and an outlet 26 for discharging a mixture of the bottoms fraction and preheated fresh heavy hydrocarbon feedstock. Mixing zone 30 includes an inlet 31 in fluid communication with a conduit 33 for introducing a paraffinic solvent and fractionator outlet 26 for receiving the combined stream of preheated fresh hydrocarbon feedstock and the fractionator bottoms fraction. Mixing zone 30 also includes an outlet 32 for discharging a combined stream containing solvent-flocculated asphaltenes and paraffinic solvent. Furnace 40 includes an inlet 41 in fluid communication with mixing zone outlet 32 and an outlet 42 for discharging heated combined stream. Coking drum 50 includes an inlet 51 in fluid communication with furnace outlet 42 and an outlet 52 in fluid communication with fractionator inlet 21 for receiving the delayed coking product stream.

In the practice of the method of the invention, a fresh heavy hydrocarbon feedstock containing asphaltenes is introduced into the lower portion of the fractionator 20 via inlet 27. The preheated feedstock is combined with the fractionator bottoms stream and passed to mixing zone 30 via inlet 31. A paraffinic solvent is introduced into mixing zone 30 via conduit 33 in a ratio of solvent-to-feedstream of from 0.1:1 to 10:1 by volume to form solvent-flocculated asphaltenes in the combined stream. The combined stream containing solvent-flocculated asphaltenes and paraffinic solvent is discharged via outlet 32 and introduced into furnace 40 via inlet 41 where it is heated to a predetermined coking temperature in the range 480° C. to 530° C. The heated combined stream is discharged via outlet 42 and passed to coking drum 50 via inlet 51 to produce the delayed coking product stream having an increased portion of liquids and to deposit a reduced amount of coke on the interior of the drum. The delayed coking product stream is discharged via outlet 52 and passed to fractionator 20 where it is fractionated to produce a paraffinic light naphtha solvent boiling in the range 36° C. to 75° C. via outlet 22, a heavy naphtha product boiling in the range 75° C. to 180° C. via outlet 23, a light gas oil boiling in the range 180° C. to 370° C. via outlet 24, a heavy coker gas oil boiling in the range 370° C. to 520° C. via outlet 25, and a bottoms fraction boiling in the range above 520° C. via outlet 26. Optionally, a portion of paraffinic light naphtha solvent is recycled back to conduit 33 to minimize the use of fresh paraffinic solvent.

Figure 3:
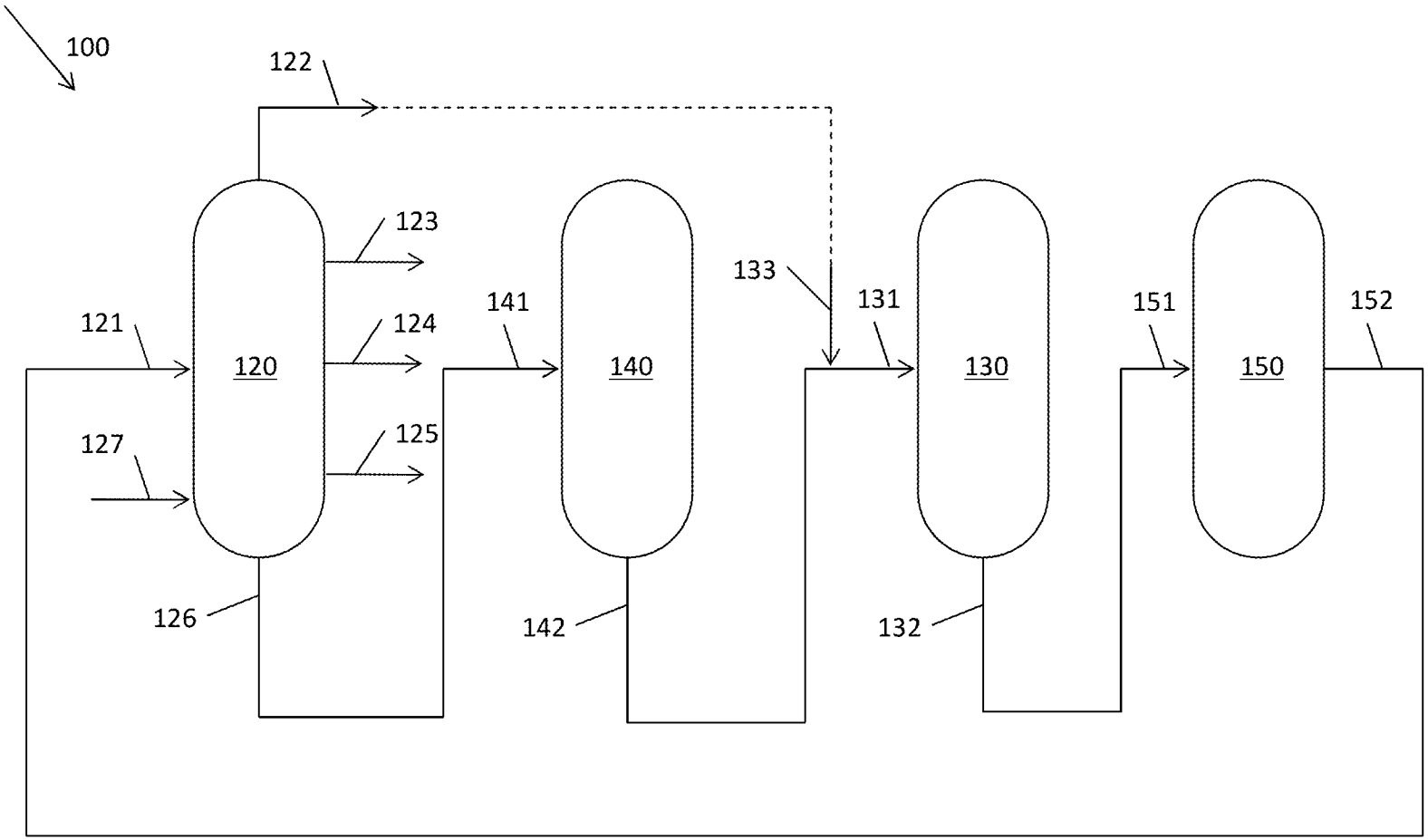
FIG. 3 is a process flow diagram of another embodiment of an improved delayed coking system and process in accordance with the present invention.

Referring to FIG. 3, an improved delayed coking process and apparatus 100 is schematically illustrated. Apparatus 100 includes a fractionator 120, a mixing zone 130, a furnace 140 and a coking drum 150. Fractionator 120 includes an inlet 127 for receiving fresh heavy hydrocarbon feedstock, an inlet 121 in fluid communication with a coking drum outlet 152 for receiving delayed coking product stream. Fractionator 120 also includes an outlet 122 for discharging a light naphtha fraction, an outlet 123 for discharging a heavy naphtha fraction, an outlet 124 for discharging a gas oil fraction, an outlet 125 for discharging a heavy gas oil fraction, and an outlet 126 for discharging a mixture of the bottoms fraction and preheated fresh heavy hydrocarbon feedstock. Furnace 140 includes an inlet 141 in fluid communication with fractionator outlet 126 and an outlet 142 for discharging heated combined stream of bottoms fraction and fresh heavy hydrocarbon feedstock. Mixing zone 130 includes an inlet 131 in fluid communication with a conduit 133 for receiving a paraffinic solvent and furnace outlet 142 for receiving heated combined stream. Mixing zone 130 also includes an outlet 132 for discharging combined stream containing solvent-flocculated asphaltenes and paraffinic solvent. Coking drum 150 includes an inlet 151 in fluid communication with mixing zone outlet 132 and an outlet 152 in fluid communication with fractionator inlet 121 for receiving delayed coking product stream.

A fresh heavy hydrocarbon feedstock containing asphaltenes is introduced into the lower portion of the fractionator 120 via inlet 127. The preheated feedstock is combined with fractionator bottoms stream and passed to furnace 140 via inlet 141 where it is heated to a predetermined coking temperature in the range 480° C. to 530° C. The heated combined stream is conveyed to mixing zone 130 via inlet 131. A paraffinic solvent is introduced into mixing zone 130 via conduit 133 in a ratio of solvent-to-feedstream of from 0.1:1 to 10:1 by volume to form solvent-flocculated asphaltenes in the combined stream. The combined stream containing solvent-flocculated asphaltenes and paraffinic solvent is discharged via outlet 132 and passed to coking drum 150 via inlet 151 to produce the delayed coking product stream having an increased portion of liquids and to deposit a reduced amount of coke on the interior of the drum, relative to the prior art process. The delayed coking product stream is discharged via outlet 152 and passed to fractionator 120 where it is fractionated to produce a light naphtha containing paraffinic solvent boiling in the range 36° C. to 75° C. via outlet 122, a heavy naphtha boiling in the range 75° C. to 180° C. via outlet 123, a light gas oil boiling in the range 180° C. to 370° C. via outlet 124, a heavy coker gas oil boiling in the range 370° C. to 520° C. via outlet 125, and a bottoms fraction boiling in the range above 520° C. via outlet 126. Optionally, a portion of light naphtha containing paraffinic solvent is recycled back to conduit 133 to minimize the use of fresh paraffinic solvent.

Figure 4:
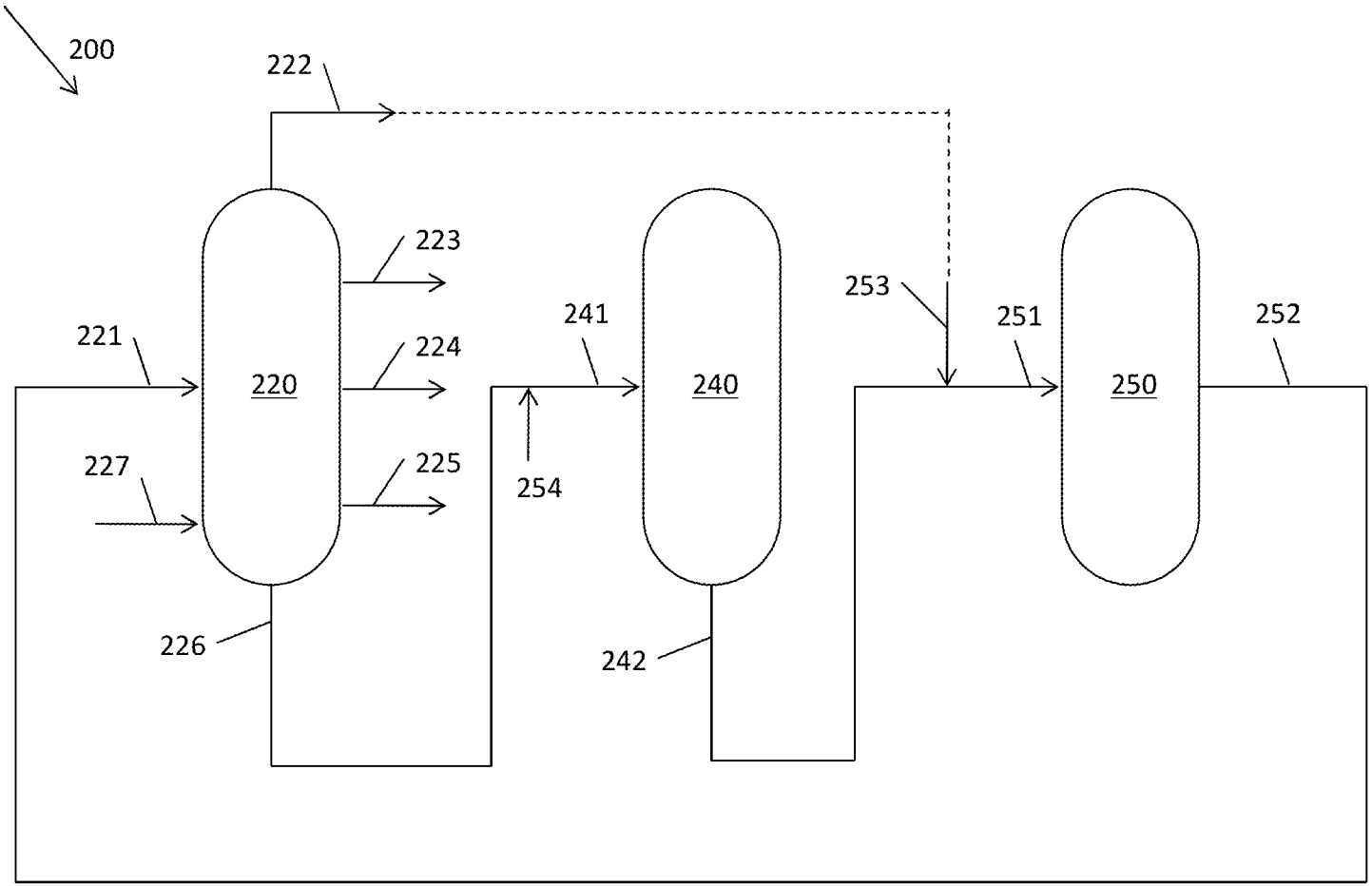
FIG. 4 is a process flow diagram of a further embodiment of an improved delayed coking system and process of the present invention.

Referring to FIG. 4, an improved delayed coking process and apparatus 200 is schematically illustrated. Apparatus 200 includes a fractionator 220, a furnace 240 and a coking drum 250. Fractionator 220 includes an inlet 227 for receiving fresh heavy hydrocarbon feedstock, an inlet 221 in fluid communication with a coking drum outlet 252 for receiving delayed coking product stream. Fractionator 220 also includes an outlet 222 for discharging light naphtha fraction, an outlet 223 for discharging a heavy naphtha fraction, an outlet 224 for discharging a gas oil fraction, an outlet 225 for discharging a heavy gas oil fraction, and an outlet 226 for discharging a mixture of the bottoms fraction and preheated fresh heavy hydrocarbon feedstock. Furnace 240 includes an inlet 241 that is in fluid communication with a conduit 254 for receiving a paraffinic solvent and with fractionator outlet 226 and an outlet 242 for discharging heated combined stream of bottoms fraction and fresh heavy hydrocarbon feedstock. Coking drum 250 includes an inlet 251 in fluid communication with a conduit 253 for receiving a paraffinic solvent and furnace outlet 242 for receiving heated combined stream. Coking drum 250 also includes an outlet 252 for discharging delayed coking product stream.

A fresh heavy hydrocarbon feedstock containing asphaltenes is introduced into the lower portion of the fractionator 220 via inlet 227. The preheated feedstock is combined with fractionator bottoms stream and passed to furnace 240 via inlet 241 where it is heated to a predetermined coking temperature in the range 480° C. to 530° C. The heated combined stream is conveyed to coking drum 250 via inlet 251. A paraffinic solvent is introduced into coking drum 250 via conduit 253 in a ratio of solvent-to-feedstream of from 0.1:1 to 10:1 by volume to form solvent-flocculated asphaltenes in the combined stream. Combined stream containing solvent-flocculated asphaltenes and paraffinic solvent is processed in coking drum 250 to produce the delayed coking product stream having increased portion of liquids and deposit a reduced amount of coke on the interior of the drum. The delayed coking product stream is discharged via outlet 252 and passed to fractionator 220 where it is fractionated to produce a light naphtha containing paraffinic solvent boiling in the range 36° C. to 75° C. via outlet 222, a heavy naphtha boiling in the range 75° C. to 180° C. via outlet 223, a light gas oil boiling in the range 180° C. to 370° C. via outlet 224 a heavy coker gas oil boiling in the range 370° C. to 520° C. via outlet 225, and a bottoms fraction boiling in the range above 520° C. via outlet 226. Optionally, a portion of light naphtha containing paraffinic solvent is recycled back to conduit 253 to minimize the use of fresh paraffinic solvent.

The feedstocks for the improved delayed coking process described herein are heavy hydrocarbons derived from natural resources including crude oil, bitumen, tar sands and shale oils, or from refinery processes including atmospheric or vacuum residue, products from coking, visbreaker and fluid catalytic cracking operations. The heavy hydrocarbon feedstock has a boiling point in the range of from 36° C., this being the boiling point of pentane, up to 2000° C. Some heavy hydrocarbon feedstocks such as bitumens include little light hydrocarbons. In these cases, the feedstock can have an initial boiling point (IBP) of 180° C., e.g., the IBP of gas oils, or 370° C., e.g., the IBP of vacuum gas oil.

The paraffinic solvent has the general formula of $C_nH_{2n+2}$, where n can be from 3 to 8. As noted above, a portion of the light naphtha stream from the fractionator can be used as the solvent that is mixed with the feedstream to the furnace or the coking drum. In accordance with the definition of light naphtha conventionally used in the art, octanes and olefin compounds, including pentenes, hexenes, heptenes and octenes, can also be present in the mixture. The presence of $C_3$ and $C_4$ compounds on the mixture will be dependent upon the prevailing pressure and temperature conditions in the coking unit and upstream. The $C_5$ to $C_8$ alkanes have boiling points in the range from about 28° C. to about 114° C., and the $C_5$ to $C_8$ olefins have initial boiling points in the range of from about 30° C. to about 121° C. The solvent is injected at a solvent battery limit temperature and a pressure of from 1 bar to 100 bars.

The coking unit is a typical delayed coking unit with two drums operating alternatively. In general, the operating conditions for the coking drum include a temperature of from 425° C. to 650° C.; in certain embodiments from 425° C. to 540° C.; in further embodiments from 450° C. to 510° C.; and in additional embodiments from 470° C. to 500° C.; and at a pressure of from 1 bar to 20 bars; in certain embodiments from 1 bar to 10 bars; and in further embodiments from 1 bar to 7 bars. The coking cycle time can be from 8 hrs to 60 hrs; in certain embodiments from 24 hrs to 48 hrs; and in further embodiments from 8 hrs to 24 hrs.

The method of the invention represents an improvement over the prior art processes by reducing the coking induction period by mixing a predetermined amount of paraffinic solvent with the heavy hydrocarbon feedstocks in order to disturb the equilibrium of the asphaltenes in the maltenes solution and to flocculate all, or substantially all of the solid asphaltenes particles. In the present process, the yield and qualities of valuable liquid products are increased while undesirable cracking and the formation of coke are minimized.

The method and system of the present invention have been described above and in the attached drawings; however, modifications will be apparent to those of ordinary skill in the art and the scope of protection for the invention is to be determined by the claims that follow.

I claim:

1. A delayed coking process for use in a delayed coking unit that includes at least one drum, the coking unit producing a delayed coking unit product stream and a coke product that is retained in the drum, the coking unit product stream being introduced into a coking product stream fractionator to produce at least a bottoms fraction, an intermediate fraction and a light naphtha fraction, the process comprising:

a. analyzing a sample of fresh heavy hydrocarbon feedstock containing asphaltenes that is to be subjected to the delayed coking process to determine the paraffinic solvent-to-asphaltenes ratio required to flocculate substantially all of the asphaltenes in the feedstock;

b. introducing the fresh heavy hydrocarbon feedstock containing asphaltenes for preheating into the lower portion of the coking product stream fractionator;

c. discharging the bottoms fraction that includes the preheated fresh hydrocarbon feedstock from the fractionator as a coking unit combined feedstream;

d. introducing a paraffinic solvent having the formula $C_nH_{2n+2}$, where n can be from 3 to 8 or a combined paraffinic and olefinic solvent, the latter having the formula $C_nH_{2n}$, where n can be from 3 to 8, into the coking unit combined feedstream with a sufficient ratio of solvent-to-feedstream to solvent-flocculate substantially all of the asphaltenes in the coking unit combined feedstream, the solvent being introduced after the discharge of the coking unit combined feedstream from the coking product fractionator and prior to passing the combined coking unit feedstream to the delayed coking drum;

e. introducing the coking unit combined feedstream which contains asphaltenes into the coking unit furnace for heating to a predetermined coking temperature; and f. passing the heated combined feedstream containing solvent-flocculated asphaltenes and paraffinic solvent to the delayed coking drum to produce the delayed coking product stream having an increased portion of liquids and depositing a reduced amount of coke on the interior of the drum, as compared to the amount of coke deposited in the absence of the addition of the paraffinic solvent to the same heavy hydrocarbon feedstock.

2. The process of claim 1 in which the ratio of solvent-to-feedstream is from 0.1:1 to 10:1 by volume.

3. The delayed coking process of claim 1, wherein the paraffinic solvent has an initial boiling point of up to 80° C.

4. The delayed coking process of claim 1, wherein at least a portion of a light naphtha fraction having a boiling point less than 80° C. and substantially free of aromatic compounds recovered from the coking product fractionator is introduced into the coking unit combined feedstream.

5. The delayed coking process of claim 4, wherein the light naphtha stream withdrawn from the fractionator and introduced into the coking unit combined feedstream includes a mixture of alkanes and alkenes.

6. The delayed coking process of claim 4, wherein a light gas oil is recovered from the fractionator as a separate stream with the light naphtha stream.

7. The delayed coking process of claim 1, wherein the paraffinic or combined paraffinic olefinic solvent is introduced into the coking unit combined feedstream in a solvent mixing zone intermediate the coking product fractionator and the coking unit furnace.

8. The delayed coking process of claim 1, wherein the paraffinic or combined paraffinic olefinic solvent is introduced into the coking unit combined feedstream in a solvent mixing zone intermediate the coking unit furnace and the coking drum.

9. The delayed coking process of claim 1, wherein the paraffinic or combined paraffinic olefinic solvent is injected into the coking unit combined feedstream prior to the coking drum.

10. The delayed coking process of claim 1, wherein step (d) includes heating the coking unit combined feedstream to a temperature in the range of from 480° C. to 530° C. at a pressure in the range of from 1 to 20 bars.

11. The delayed coking process of claim 10, wherein the pressure is in the range of from 1 to 10 bars.

12. The delayed coking process of claim 10, wherein the pressure is in the range of from 1 to 7 bars.

13. The delayed coking process of claim 1, wherein the heavy hydrocarbon feedstock is an unrefined hydrocarbon source selected from the group consisting of crude oil, bitumen, tar sands, shale oils, coal liquefaction liquids, and combinations thereof.

14. The delayed coking process of claim 1, wherein the heavy hydrocarbon feedstock is derived from a refined hydrocarbon source selected from the group consisting of atmospheric residue, vacuum residue, visbreaker products, fluid catalytic cracking products or by-products, and combinations thereof.

15. The delayed coking process of claim 1, wherein the heavy hydrocarbon feedstock is a mixture having a boiling point between 36° C. and 2000° C.

16. The delayed coking process of claim 1 in which the coking unit includes two drums and the process is operated in swing mode.

17. The delayed coking process of claim 1, where in the coking cycle is reduced by at least 30%.

18. A delayed coking process for use in a delayed coking unit that includes at least one drum, the coking unit producing a delayed coking product stream and a coke product that is retained in the drum, the coking product stream being introduced into a coking product stream fractionator to produce at least a bottoms fraction, an intermediate fraction and a light naphtha fraction, the process comprising:

a. analyzing a sample of fresh heavy hydrocarbon feedstock containing asphaltenes that is to be subjected to the delayed coking process to determine the paraffinic solvent-to-asphaltenes ratio required to flocculate substantially all of the asphaltenes;

b. introducing the fresh heavy hydrocarbon feedstock containing asphaltenes for preheating into the lower portion of the coking product fractionator;

c. discharging the bottoms fraction that includes the preheated fresh hydrocarbon feedstock from the fractionator as a coking unit combined feedstream;

d. introducing the coking unit combined feedstream into the coking unit furnace for heating to a predetermined coking temperature;

e. mixing a paraffinic solvent having the formula $C_nH_{2n+2}$, where n=3 to 8, with the furnace-heated coking unit combined feedstream in a ratio of solvent-to-feedstream of from 0.1:1 to 10:1 by volume to form solvent-flocculated asphaltenes in the furnace heated coking unit combined feedstream;

f. passing the furnace-heated coking unit combined feedstream containing the solvent-flocculated asphaltenes and paraffinic solvent to the delayed coking drum to produce the delayed coking unit product stream having an increased portion of liquids and depositing a reduced amount of coke on the interior of the drum, as compared to the amount of coke deposited in the absence of the addition of the paraffinic solvent to the same heavy hydrocarbon feedstock.

19. The delayed coking process of claim 18, wherein the mixing of paraffinic solvent and the furnace-heated coking unit combined feedstream occurs in a mixing zone.

20. The delayed coking process of claim 18, wherein the paraffinic solvent is injected directly into the furnace-heated coking unit combined feedstream.

* * * * *